US007152507B2

(12) United States Patent
Solari

(10) Patent No.: US 7,152,507 B2
(45) Date of Patent: Dec. 26, 2006

(54) TONGUE AND GROOVE SHEET DECKING INSTALLATION KIT, INCLUDING PROTECTOR BLOCK CONTROLLER SHOE AND SLEDGEHAMMER ATTACHMENT

(76) Inventor: Federick C. Solari, 144 Texas St., Marshfield, MA (US) 02050

( * ) Notice: Subject to any disclaimer, the term of this patent is extended or adjusted under 35 U.S.C. 154(b) by 124 days.

(21) Appl. No.: 10/901,802

(22) Filed: Jul. 30, 2004

(65) Prior Publication Data

US 2006/0021475 A1 Feb. 2, 2006

(51) Int. Cl.
*E04F 15/00* (2006.01)

(52) U.S. Cl. ..... 81/46

(58) Field of Classification Search ..... 81/21, 81/25, 26, 46, 180.1, 488; 7/143; 254/11
See application file for complete search history.

(56) References Cited

U.S. PATENT DOCUMENTS 847,272 A * 3/1907 Ayers ..... 81/46
1,161,207 A * 11/1915 Hagel ..... 81/46
2,654,408 A * 10/1953 Leslie ..... 81/46
5,456,053 A * 10/1995 Fischer ..... 52/749.1
5,845,548 A * 12/1998 Nelson ..... 81/46
6,386,071 B1 * 5/2002 McIntyre ..... 81/22
6,739,010 B1 * 5/2004 Lin ..... 7/143

* cited by examiner

*Primary Examiner*—David B. Thomas
(74) *Attorney, Agent, or Firm*—John M. Brandt

(57) ABSTRACT

A Kit with a protector block controller shoe being a treadle with two upwardly raised sides, a handle and a crossbar laterally placed before the operator's foot so when the controller shoe is attached by the crossbar to a protector block of standard dimension and material it allows the operator to control the protector block from a new, safer, more comfortable and more advantageous position, and when a sledgehammer attachment has two plates attached width to width at a slightly acute angle with sides to maintain that angle under heavy impact and to provide a pocket for the sledgehammer head to fit into and be held by a clamp and retaining lip in order to change one or more striking surfaces to a new angle inward with respect to a longitudinal line passing through the center of the handle, and to enlarge that surface in order to allow the operator to impact the protector block from the said new, safer, more comfortable and more advantageous position than with any prior art in the same field.

12 Claims, 9 Drawing Sheets

Previous Method

TONGUE AND GROOVE SHEET DECKING INSTALLATION KIT, INCLUDING PROTECTOR BLOCK CONTROLLER SHOE AND SLEDGEHAMMER ATTACHMENT

REFERENCES CITED

Dobbertin, Aug. 4, 1987 . . . U.S. Pat. No. 4,683,631
Roberts, Jul. 25, 1995 . . . U.S. Pat. No. 5,435,610
Kellenbarger, Sep. 20, 1955 . . . U.S. Pat. No. 2,718,374
O. A. Johnson, Feb. 12, 1952 . . . U.S. Pat. No. 2,585,013
Marcon, Jun. 11, 2002 . . . U.S. Pat. No. 6,402,121
Pasto, Oct. 12, 1999 . . . U.S. Pat. No. 5,964,450
Lassahn, Aug. 4, 1964 . . . U.S. Pat. No. 3,143,335
Shelton, Jul. 4, 1882 . . . U.S. Pat. No. 260,423

BACKGROUND OF THE INVENTION

This invention is designed to be used by carpenters and carpenter's helpers in the residential and small commercial building construction trade, specifically in the installation of ¾" by 4' by 8' tongue and groove sub-flooring of various materials, including plywood and pressed, particle board. These sheets or boards are installed with glue and nails on top of joists, frame members or timbers that create the "support" for the floor this sub-flooring becomes part of. Finished flooring is then installed on top of this sub-flooring. This process is fairly uniform throughout the industry in North America and elsewhere.

Each sheet of flooring has a groove along one 8' edge routed into the ¾" vertical surface (with the sheet oriented as it sits installed) longitudinally ⅜" deep and ¼" wide in the center of the surface causing this edge to be named the "female edge." And on the opposite 8' edge, the sheet has a tongue routed similarly and longitudinally in such a way as to enable it to fit perfectly into and against the "female edge" of another and separate sheet, and causing it to be called the "male edge." When these two edges fit together with the sheets of sub-flooring sitting side by side and flat on straight and true supports they create a flat, smooth and sturdy sub-floor, ready to receive finished flooring. These "male" and "female" edges fit very snugly and require high impacting with a heavy tool such as a sledgehammer to make them joined in the finished position. The 4' edge of each sheet is left square and smooth for it butts the next sheet beside it with a support running longitudinally and centered under each and every joint at that point. However, this joint [I will call it the "end joint"] must also be closed with an impact applied to the open 4' edge.

A "protector block," usually constructed of a scrap piece of 1½" by 3½" framing stock called "2×4" usually 8' long, is rested on the supports and against the female edge of the sub-flooring sheet to be installed while this sheet is placed along side the female edge of a previous sheet which has been fastened permanently to the supports. The protector block avoids damage that would be caused by the sledgehammer directly contacting any of the edges of the sub-flooring. A carpenter uses the sledgehammer to impact the protector block which then impacts the sheet, causing it to join with the sheet before it. To close the end joint, the carpenter or helper must get on his knees, choke up on the sledge-hammer handle, much like you would with a baseball bat, and hold a separate protector block usually 4' long against the open 4' edge and impact it. By the nature of framing there are no supports to rest the shorter protector block on during the closing of the end joint.

Installing sub-flooring in this manner (Drawing 8/9) is considered by most carpenters and carpenters' helpers to be one of the most difficult and dangerous jobs, if not the most difficult and dangerous job, in this industry. The 8' protector block must be held in place by the carpenter or helper placing the balls of both feet on it, leaving only the heels of his feet resting on the still unfastened sheet of sub-flooring being installed. At the same time he must lean his entire upper body out over open supports so that a horizontal impact can be applied against the protector block by swinging the sledgehammer under his upper body. The small of the back does almost all of the work. The dangerous balancing over open joists or timbers is stressful, with exposure to drops of as much as 16' to the deck or floor below, adding strain to the hard work. And the difficulty of making accurate contact with the 2×4 protector block sometimes leads to off center hits on the impact surface causing the protector block to shatter, sometimes leading to injury. There have been many inventions over the years invented to improve this process, some of which I list below, however, do to shortcomings of diverse nature, none of these have been adopted nationwide, if at all. The choice by almost all carpenters, do to its simplicity, and the lack of many of the shortcomings of current new inventions, is still the plain sledgehammer bought at any hardware store or lumberyard. That is why I will call this use of the simple sledge-hammer (Drawing 8/9) the "prior method." My invention has shown, by on the job testing of the prototype, that it greatly reduces the difficulty of the prior method and changes it. It also speeds it up, and shows none of the shortcomings of previous new inventions.

BRIEF SUMMARY OF THE INVENTION

My invention includes two main parts: First, the protector block controller shoe. Second, The sledgehammer attachment.

The protector block controller shoe is a metal shoe with a handle and a crossbar placed at a comfortable position in front of the operator's foot with the handle above and the crossbar below, so that when the shoe is attached by the crossbar with 1⅝" decking screws or the like to a 2×4 protector block 36" to 45" long, and when the operator's foot is placed in it, it allows the operator to control the protector block from a new, more comfortable and safer position, to slide the protector block back and forth along the edge of the sheet of flooring to be installed, and to pull and hold it tight to the said edge.

The sledgehammer attachment fits onto a standard 8 lb sledgehammer obtainable at most hardware stores, lumberyards and home centers in North America. The sledgehammer slides into a cup built into the attachment and is held fast by a large u-clamp. The attachment alters one of the striking surfaces of the sledgehammer from parallel to a different angle inward with respect to a line longitudinally through the center of the handle, and enlarges this striking surface. The new angle allows the user to strike the protector block easily and comfortably from the new, more comfortable and safer position. The larger striking surface makes it easier to strike the protector block without missing. And the extra weight of the attachment increases the power of the sledgehammer making it unnecessary to lift it higher than about the waist. Impact is achieved by swinging the hammer with the attachment out beyond the protector block at about waist height and pulling horizontally [as in a tug of war game] as it falls, keeping one's back vertical, and using arm and leg strength mostly. An outrigger arm is attached to the attachment top and extends back to a point on the handle about 6"

from where the handle attaches to the sledgehammer head and is attached with a small clamp that encircles the handle at that point. This is done to spread the increased impact pressure caused by the enlarged striking surface out to a larger section of the handle, much the same way as is done on a standard brush hook(Shelton, Jul. 4, 1882 U.S. Pat. No. 260,423)with a large extended blade.

This "kit," as these two combined parts can be called, reduces by a considerable amount the difficulty and danger of this job or process done with the prior method described above and below, almost eliminating the stress created by the prior method on the lower back, and speeding up the process by reducing the number of blows needed, the number of misses that result, the amount of energy needed, and the amount of motion needed, using the prior method. One example is the end joint can now be closed by impacting the open 4' edge using the exact same tool and exact same motion as joining the 8' male and female edges. Another example is the whipping action needed to fully utilize the power of the sledgehammer is achieved in a new and easier way as if pulling in a tug of war game from a lower height.

BRIEF DESCRIPTION OF THE SEVERAL VIEWS OF THE DRAWING

There are nine drawings numbered and described as follows:

1/9 Side view of the controller shoe
2/9 Top view of the controller shoe
3/9 Front or impact side of the controller shoe
4/9 Side view of the sledgehammer attachment
5/9 Rear or entry view of the sledgehammer attachment
6/9 Operation of the "kit" during closing of the long or tongue and groove joint
7/9 Operation of the "kit" during closing of the end joint
8/9 Prior method
9/9 New method using the preferred entity There are twenty items depicted in these drawings that are numbered from 1–20 and are listed below with a brief description:

Figure 1:
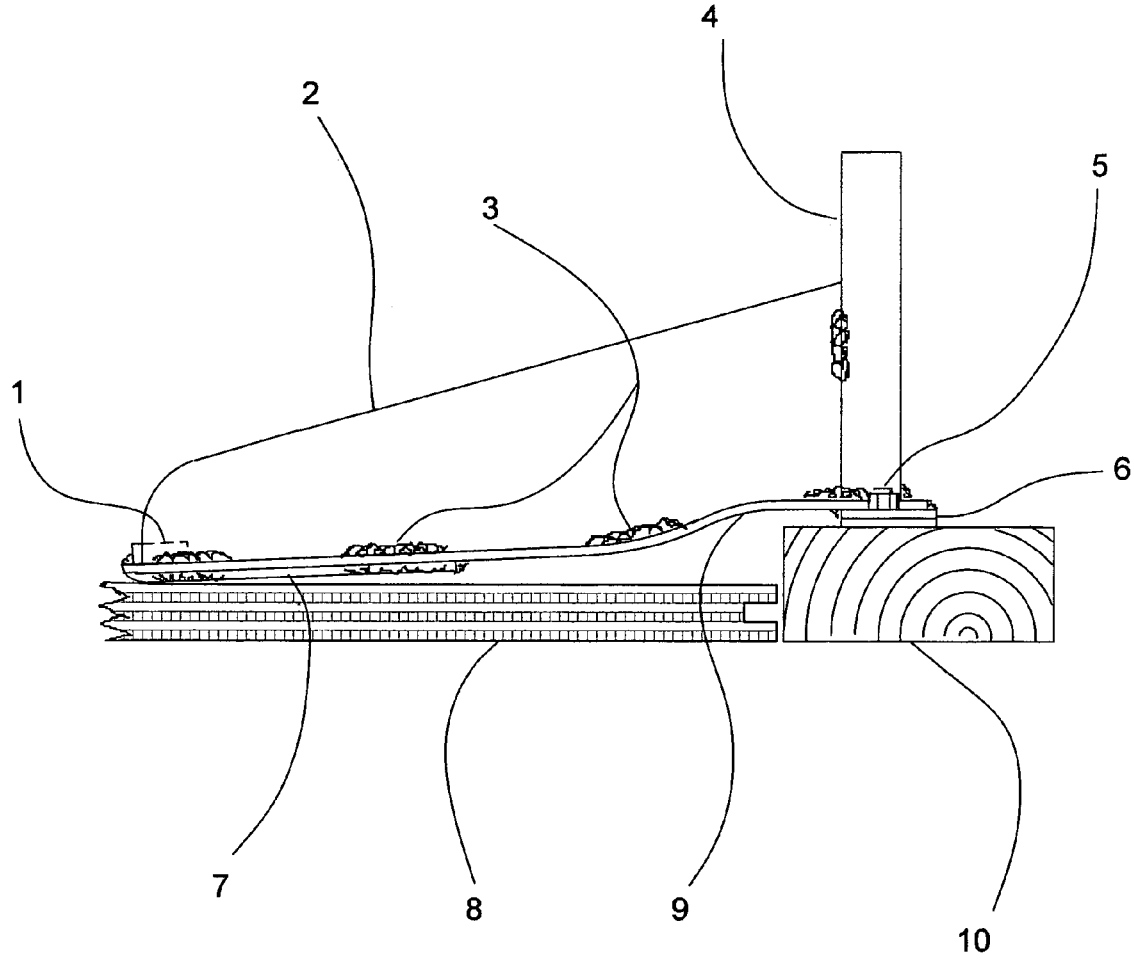
Figure 2:
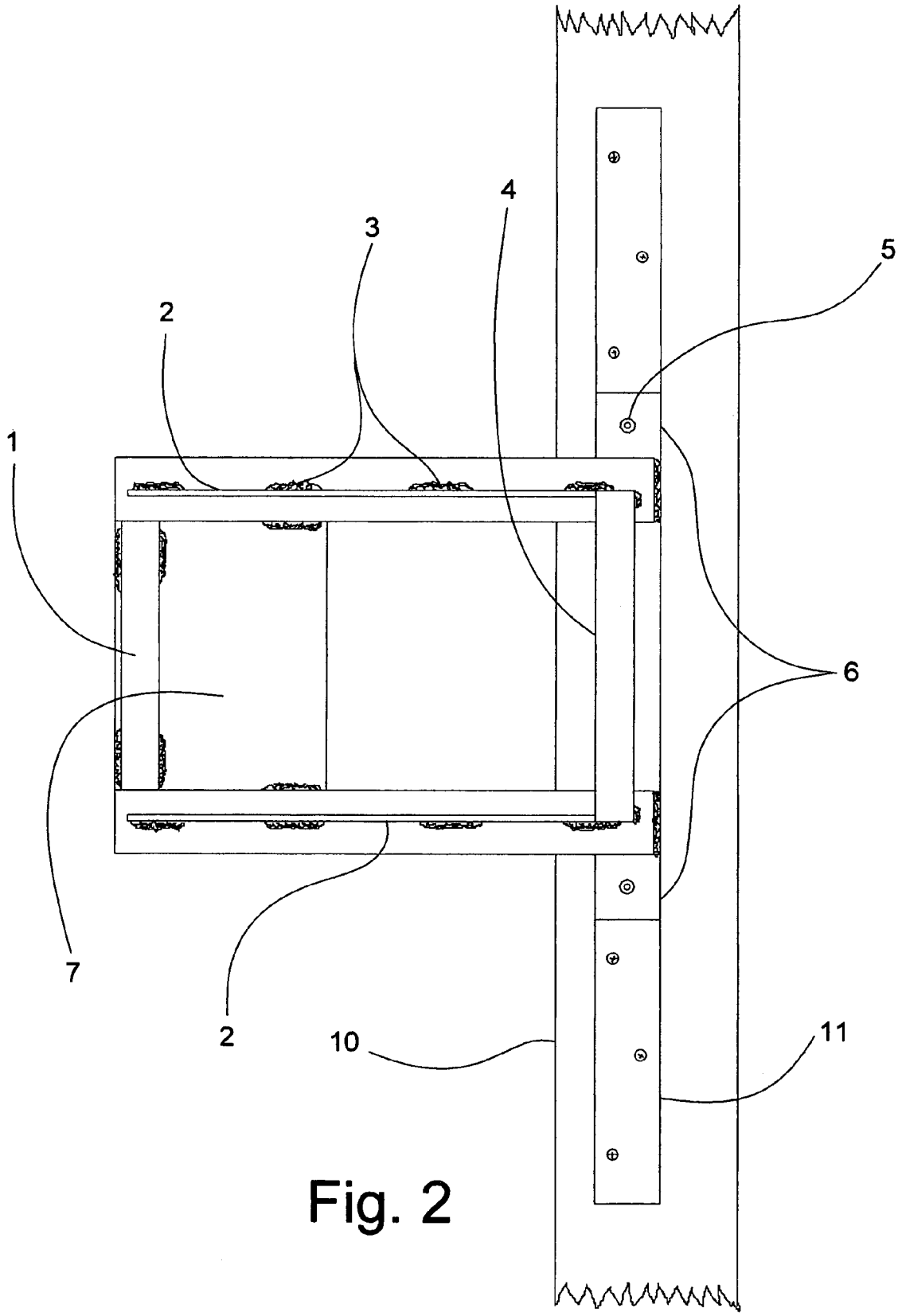
Figure 3:
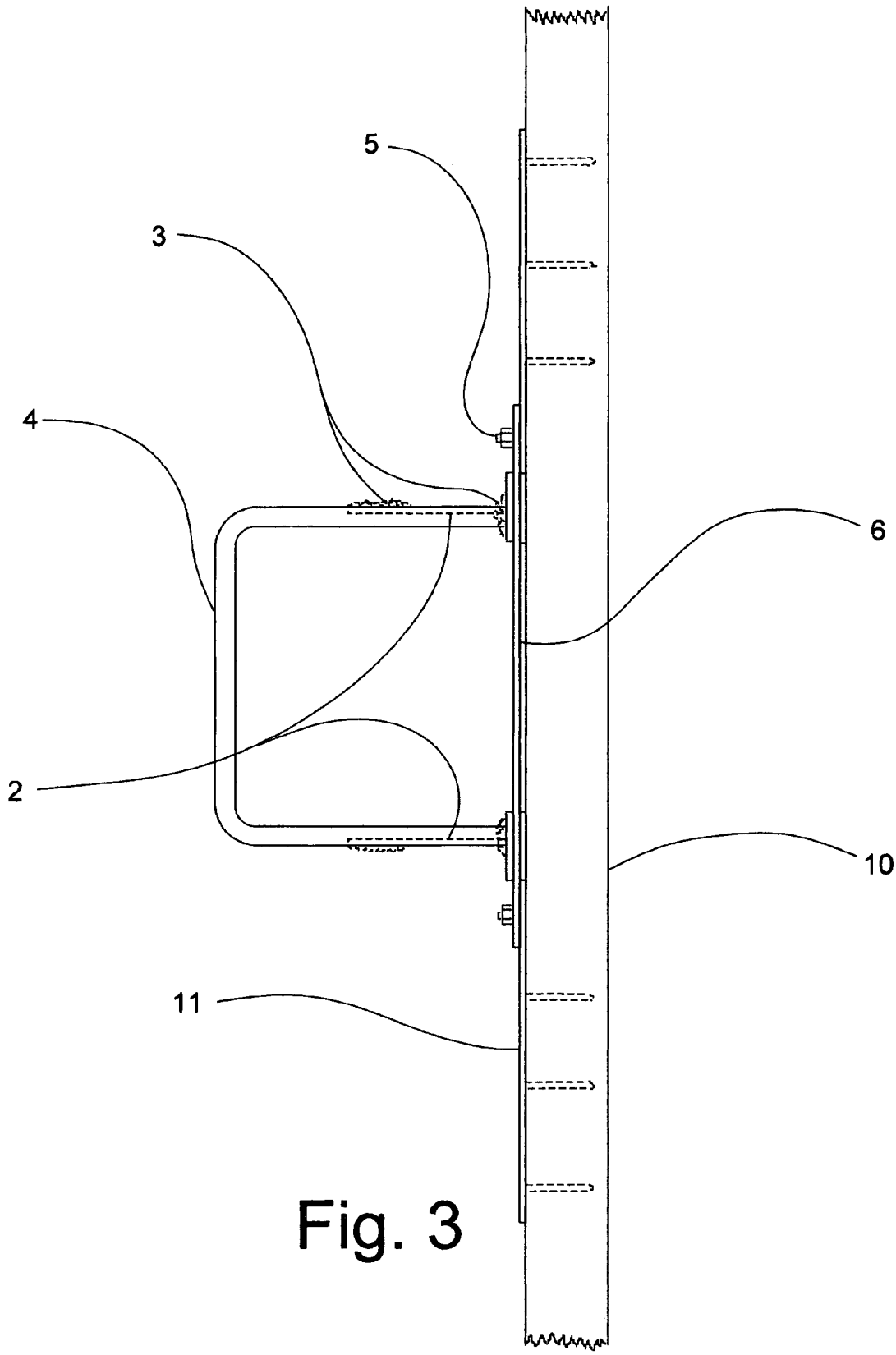
Figure 4:
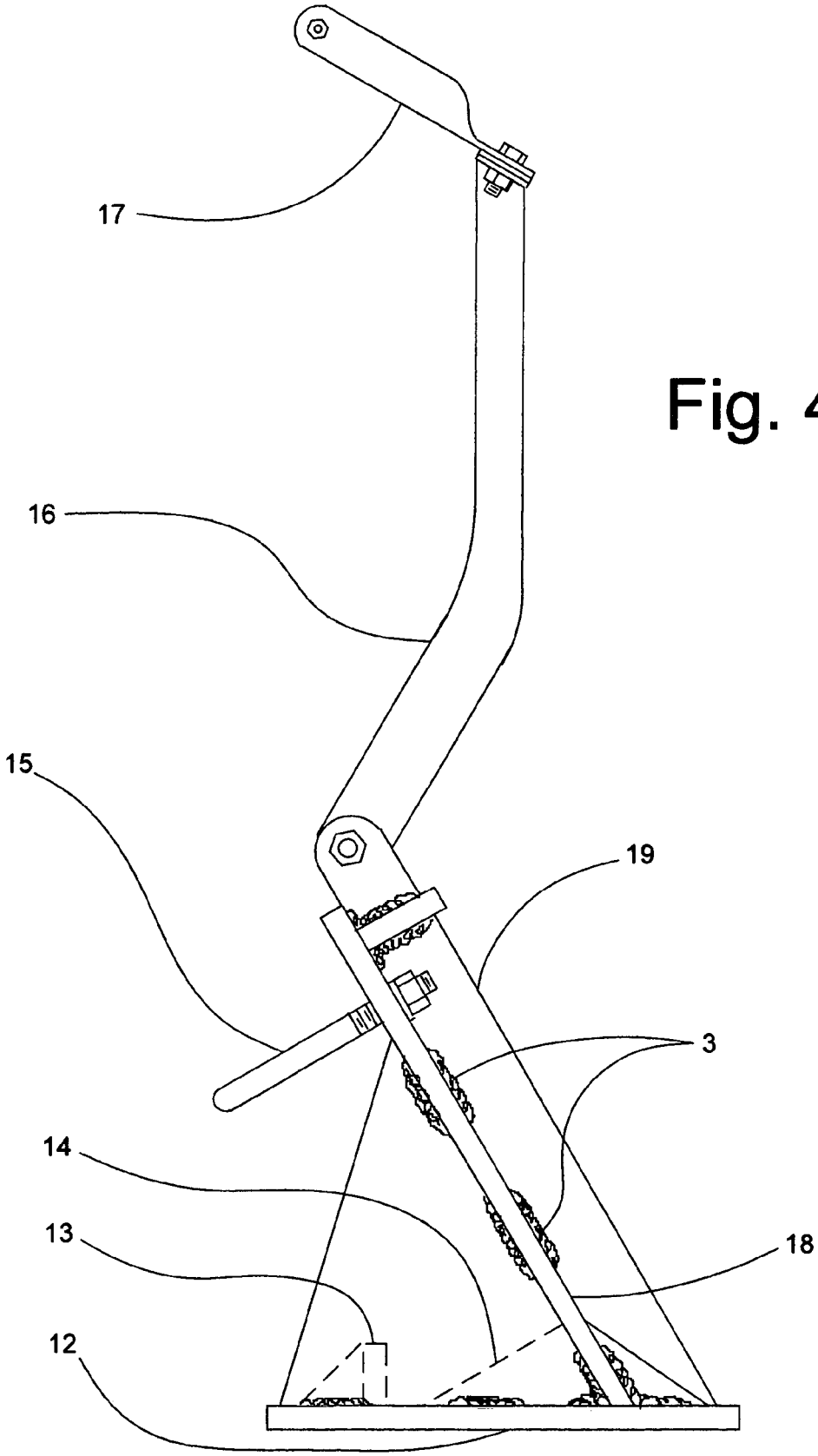
Figure 5:
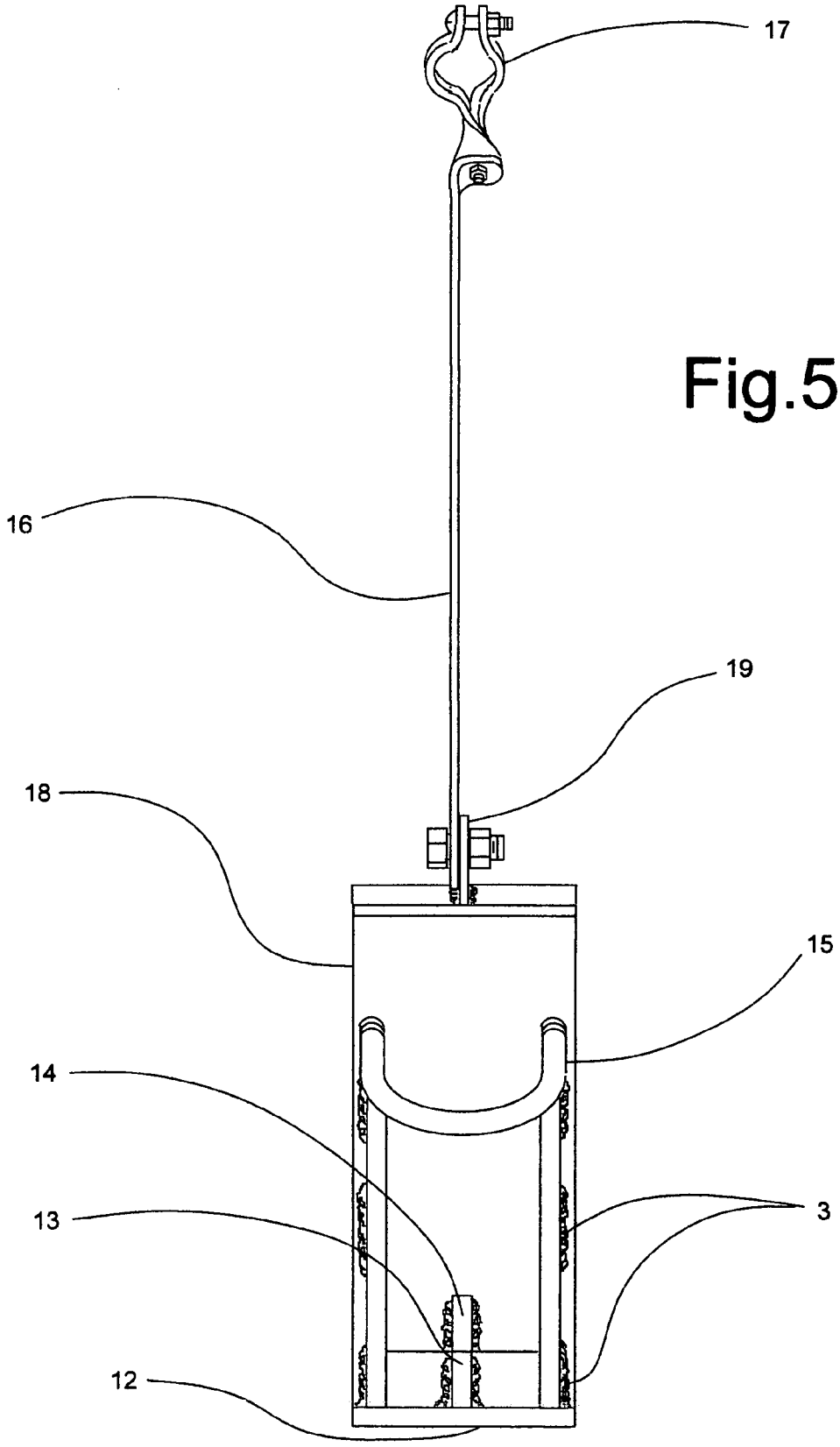
Figure 6:
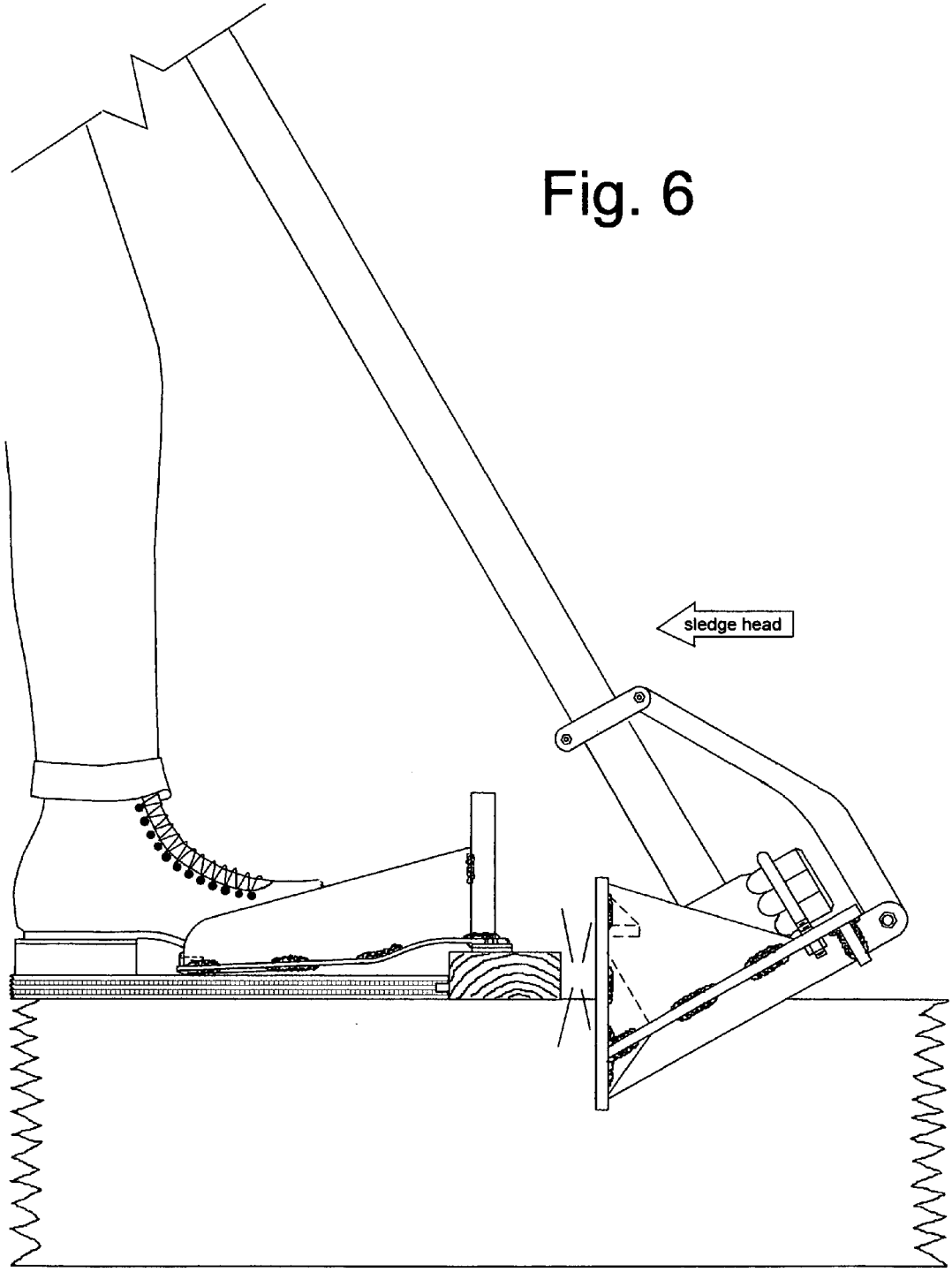
Figure 7:
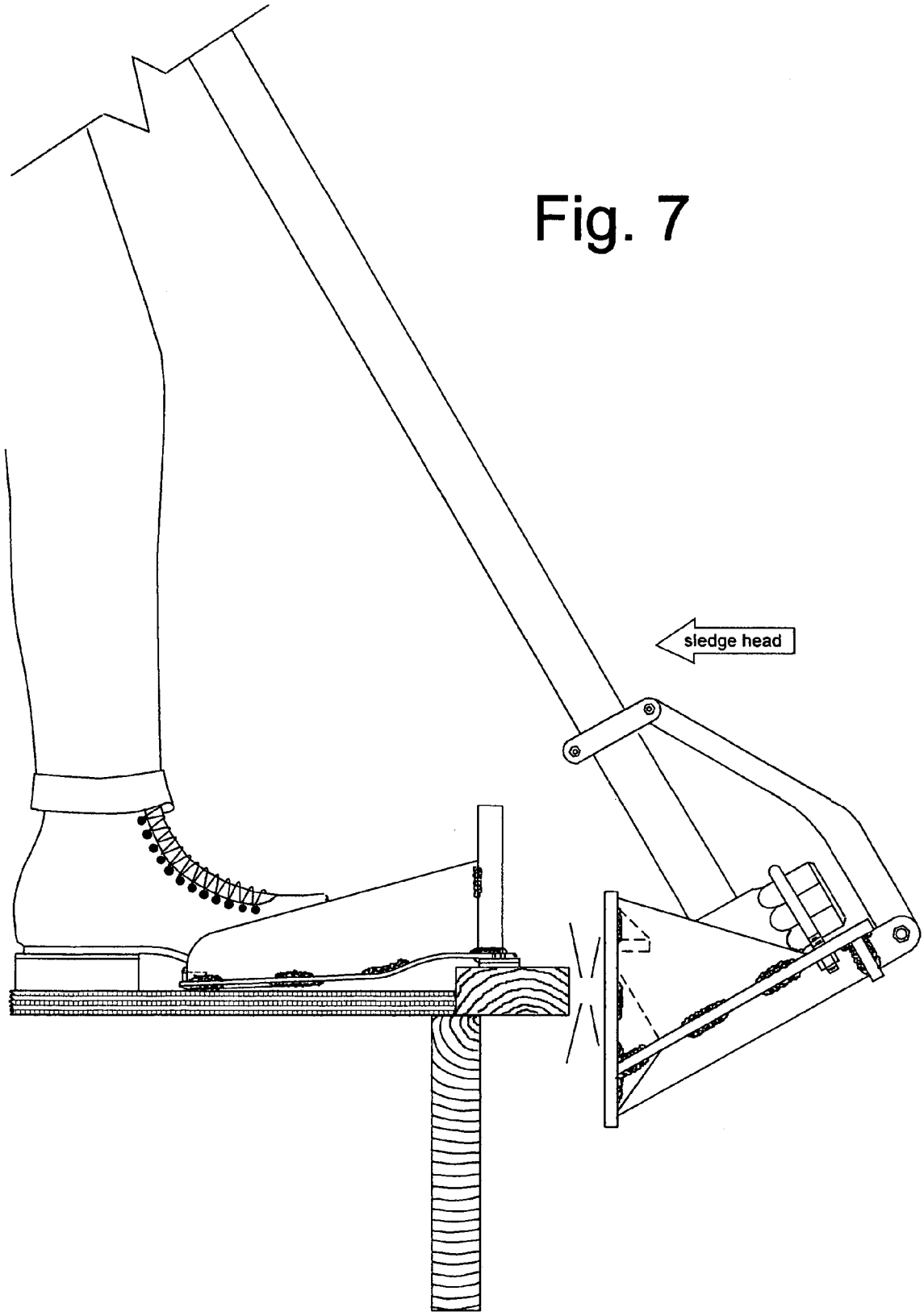
Figure 8:
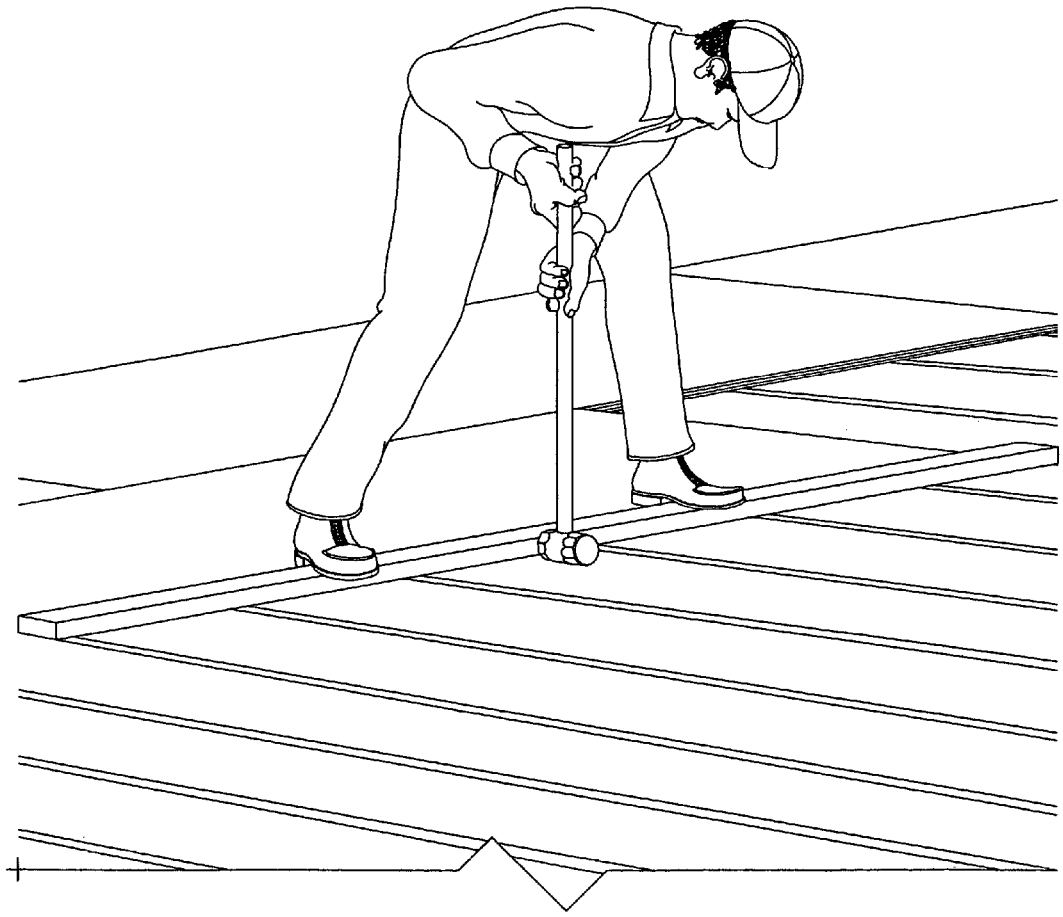
Figure 9:
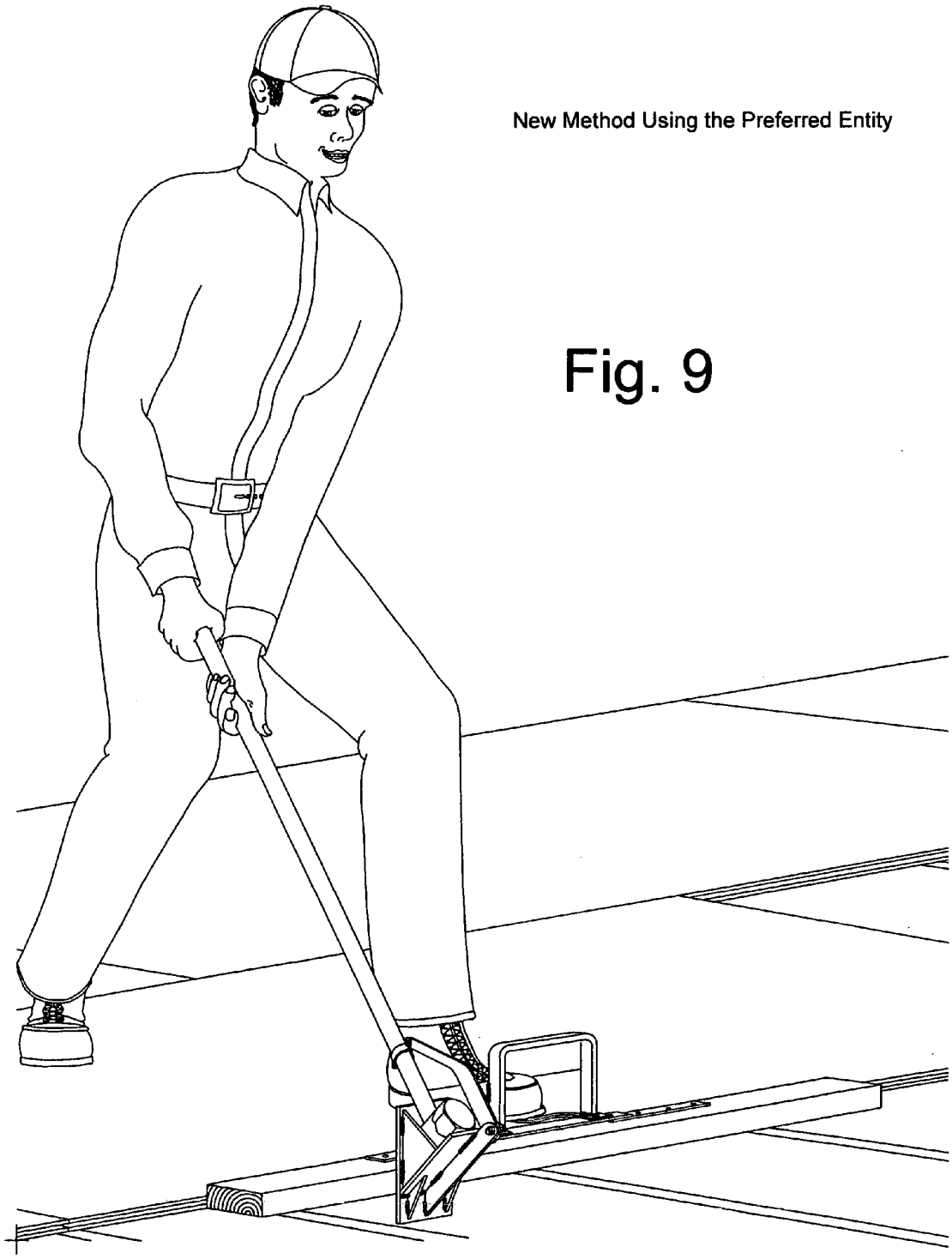

1. Pull bar
2. Side panel
3. Welds
4. Pivot bolt for retracting arms
6. Crossbar
7. Treadle
8. ¾"×4'×8' Tongue and groove decking
9. ⅝" Offset
10. 2×4 Wood block or "protector block"
11. Retracting arms
12. First plate or striking surface
13. Sledge head retaining lip
14. Striking surface transfer gusset
15. Sledge head retaining clamp
16. Impact displacement outrigger
17. Impact displacement outrigger clamp
18. Second plate
19. Outrigger mount
20. Impact side of protector shoe

DETAILED DESCRIPTION OF THE INVENTION

The invention consists of two parts, the "Protector Block Controller Shoe" and the "Sledgehammer Attachment."

The "Protector Block Controller Shoe" (Drawings 1/9, 2/9, 3/9) is basically a treadle body with two sides (2) that extend upwardly from opposite edges of the treadle plate (7) so they are on each side of the ball of the operator's foot when the ball of the foot is placed on the treadle's upper surface. A sturdy handle (4) can be added just beyond and comfortably above the spot where the toes of the operator's foot lie when the operator is using the treadle plate as said. It is recommended that the handle be made out of sturdy enough material, and fastened to the controller shoe body well enough, to withstand errant blows during impacting. A pull bar (1) made of bar stock can be welded or hot riveted close to the back edge of the top surface of the treadle so as to lie under the arch of the foot. The bar stock used should be of sufficient size to enable the operator to drag the soul of his boot against it to move the controller shoe backward (Drawings 6/9, 7/9, 9/9). A crossbar (6) of flat stock can be welded or hot riveted across the front or impact side (Drawing 3/9) of the controller shoe underneath where the handle is to be fastened and placed parallel to the line of the pull bar at the bottom of the sides. The top surface can make a small angle, downwardly, moving away from the operator's foot, with the top surface of the treadle. The crossbar should be of sufficient size to be sturdy but not so fat as to interfere with the positioning of the controller shoe for use. At the bottom of the sides, between the front edge of the treadle and the rear edge of the crossbar, an offset (9) can be achieved downward from the crossbar to the treadle sufficient enough to enable a comfortable position for the operator's foot while the controller shoe sits both on the sheet of decking to be installed and the 2×4 protector block (10), and to allow the treadle's bottom surface to achieve a small angle, about 2-degrees, with the surface of the decking sheet with the center of the angle at the rear of the treadle. This is to cause the treadle, pressured by the ball of the operator's foot, to place needed pressure on the protector block for steadying during impact. Also, the bottom rear edge of the treadle should be eased with a curved chamfer so the treadle does not gouge the decking surface. Two retracting arms (11), pieces of flat stock similar to the crossbar, can be attached rotatably to the crossbar, and on the same plane, by a single bolt or hot rivet each so they can be retracted for storage and unfolded for fastening to the protector block. These are not absolutely necessary, but do make the controller shoe more stable during impacting while also enabling the tool to be easily stored. The controller shoe can be assembled many ways from cutting the parts with a torch and welding them together to stamping the shoe shape out of a single cutting from plate in a punch press and hot riveting or spot welding the handle and crossbar to it. The size can vary quite a bit. However, It is recommended that the shoe be 6½" wide and 10½" in length with the sides tapered and measure three inches from the top surface of the protector block to their highest point. The handle should be ⅜" by ¾" bar stock or something similar in strength at least 4½ above the top surface of the protector block. The pull bar should be the same bar stock, except in the case of the stamped version where the pull bar can be a ⅜" high lip placed in the back of the treadle during stamping. Everything else should be ⅛" plate or flat stock, or something similar in strength.

The "Sledgehammer Attachment" (Drawings 4/9 through 7/9) is basically an alterant of one of the striking surfaces of a common 8 lb sledgehammer which can be purchased at most hardware stores, lumber yards and home centers throughout North America. The sledgehammer attachment can be made in various ways and various sizes, however, it is recommended that a piece of steel plate (12) 5/16" thick is cut to 3½" by 7½". A second piece (18) is cut the same width but to 8" in length. The two pieces are fastened together, by welding usually, when one 3½" end of the second piece is fitted width to width to the surface of the first at a spot 1¾" from one end of the first so as to form a 60-degree angle with the long end of the first piece (Drawing 4/9). Two triangular pieces of the same thickness are welded inside the first two pieces near the edges of both sides so as to maintain the 60-degree angle under heavy impact. These four pieces form a pocket for the head of the typical 8 lb sledgehammer described above to fit into. An impact transfer gusset (14) is cut from the same steel to fill the triangular space between the striking surface of the sledgehammer and the striking surface of the attachment when the 8 lb sledgehammer is fitted into the pocket (Drawing 4/9 through 7/9) and is meant to transfer the impact from the striking surface of the sledge to the striking surface of the attachment. The sledgehammer head is held securely in the attachment by a combination of a 5/16" thick, braced retaining lip (13) welded into the pocket on the opposite side of the sledge head from the second plate (18) and a large steel u-clamp (15) that passes around the sledge head and twice through the second plate at the opposite end of the hammer head from the impact transfer gusset and is held fast by two nuts and two lock washers.

On the leading face of the attachment created by the second plate (18), more gussets of the same steel are added to strengthen the leading edge of the striking surface. A ⅛" thick steel plate 1⅛" wide (19) is fastened on edge in the middle of the face from top to bottom and protruding above the top of the second plate 1¼". The bottom of the second plate is where it attaches to the first plate. The bottom of the ⅛" plate (19), which will be called the outrigger mount, should be angled to attach to the upper surface of the leading edge of the first plate. The outrigger mount also acts as a stiffening gusset for the face or second plate.

To the outrigger mount is fastened rotatably by a single bolt, and in the same plane, a ⅛" thick plate that begins at the attachment at 1⅛" inches wide and tapers to ¾" at the end. It is shaped to allow adequate clearance around the sledge head and also take the shortest distance to a spot on the handle 6" longitudinally from the sledge head. Here, the impact displacement outrigger (16), as it should be called, is attached by a simple clamp (17) of a certain size to enable it to fit the sledgehammer handle and be tightened in place by a strong, single bolt of the least obtrusive size. The clamp is attached to the impact displacement outrigger with a single rivet or bolt. The clamp can be made of two pieces of flat stock ⅛" thick and ¾", wide and 4" long, and be bent in such a way as to fit around the handle and leave a gap at the tightening bolt to leave room for adjustment of tightness.

The sledgehammer attachment as described above can be made as explained and attached permanently to the sledge head forming a permanently altered tool. A few craftsmen might prefer it that way, though it would often mean that the craftsman would need more space for storing tools, with an extra, altered sledgehammer having to be included with a standard sledgehammer needed for various other tasks.

The attachable invention, designed to be used with a standard sledgehammer, forms a "Kit," that can fit into a toolbox of various materials 14" long, 8" wide, and 12" high, without the standard sledgehammer.

The invention, when used with a sledgehammer of the standard type mentioned above, is a tool that when used as designed (Drawing 9/9) improves the process described above greatly by making it safer, less strenuous, and more accurate. It puts the operator in a safer, more comfortable, and more advantageous position than in the prior method described above (Drawing 8/9). It allows the operator to stand with both feet solidly on the sheet to be installed, even though the ball of one foot is on a treadle, instead of having the balls of two feet on a separate piece of wood with only the heels on the loose sheet. It eliminates the need for the operator to lean his upper body out over open supports with exposure to the deck of the story below. The larger striking surface all but eliminates misses when impacting the protector block. And the altered angle of the striking surface greatly increases the mechanical advantage of the sledgehammer two ways: one, by utilizing the added weight, and, two, by enabling the operator to create a powerful acceleration of centrifugal force necessary in the use of a sledgehammer (the whipping action) with much less effort. For instance, one aspect is the elimination of the need to lift the hammer much higher than the waist to achieve acceleration. Another is the ability to achieve acceleration of the centrifugal force using fully the arms and legs with the back in a vertical position, much like a tug of war game, as opposed to the prior method where the lower back does almost all of the work, and the whipping action has to be achieved by the lower back muscles lifting the hammer vertically, exactly opposed to gravity. The preferred entity is aided by gravity. The preferred entity method is also a great improvement ergonomically, as the back is in the vertical position, which is one of the best positions for it to be in during almost any physically demanding activity.

There are several inventions that have been developed over the years to make improvements to the process described above. One is Dobbertin, Aug. 4, 1987, U.S. Pat. No. 4,683,631. This invention seeks to improve the process but does so by suggesting a tool that is very cumbersome and hard to move and store. Constant movement is necessary because the 8' joint rarely closes evenly. The preferred entity by use of the controller shoe can impact quickly on any position on any one edge with slight sideways pressure. Dobbertin also generates friction during use which diminishes mechanical advantage. Lubrication is all but impossible because any material used for such purpose would interfere with the gluing process, which is demanded by building code for this process. Impacting with the preferred entity produces no friction. Dobbertin does put the operator in an improved position but more of the work is still done by the lower back than with the preferred entity. This tool is also completely unable to close the end joint. The preferred entity closes the end joint with the exact same motion and ease that it closes the 8' male-female joint (Drawing 7/9).

The invention by Roberts, Jul. 25, 1995, U.S. Pat. No. 5,435,610, may be easier to use than Dobbertin but is still cumbersome with many of the same drawbacks including the inability to close the end joint. Also, because of the large length of the plank, the size being necessary for the power producing weight, to get an even impact, the operator of Roberts must achieve perfect or near perfect parallel alignment between the impacting plank and the female edge of the sheet to be installed. The nature of the action would make this difficult, with the danger of damaging the female edge being possible. The ratio of size between the striking surface of the sledgehammer attachment and the protector block, together with the tight control of the protector block by the controller shoe, allows the preferred entity to eliminate this problem.

Older inventions, such as Kellenbarger, Sep. 20, 1955, U.S. Pat. No. 2,718,374, and O. A. Johnson, Feb. 12, 1952, U.S. Pat. No. 2,585,013, may not be comparable because they do not use impact and are designed, I believe, for installing tongue and groove boards, not panels. However, they could be considered useful in this process, say, with elongated handles. It should be noted, though, they would damage the supports during the process of holding on to them. They also cannot close the end joint.

Inventions such as Marcon, Jun. 11, 2002, U.S. Pat. No. 6,402,121, Pasto, Oct. 12, 1999, U.S. Pat. No. 5,964,450, and Lassahn, Aug. 4, 1964, U.S. Pat. No. 3,143,335, also have similar draw backs when compared to the preferred entity.

I claim as my invention:

1. Floor installation apparatus adapted to facilitate the installation of flooring members atop building structural components, said installation requiring the sequential compacting of said flooring members in edge to edge relationship by the use of a protector block disposed against one edge of a flooring member, said block to be struck so as to result in said compacting, said apparatus comprising in combination:

A. a plate having a forward plate portion and a rearward plate portion adapted to lie upon a previously installed segment of said flooring members, said plate of sufficient size to be pressed against said members by a human foot;

B. protector block attaching means for attaching said protector block to said forward plate portion of said plate; and C. plate controller means attached to said plate arranged to connect with said foot whereby the position of said plate may be controlled by the motion and position of said foot.

2. The floor installation apparatus of claim 1 wherein said plate controller means comprises a bar attached to the upper surface of said rearward plate portion transverse said plate, said bar arranged to fit underneath the arch of said foot.

3. The floor installation apparatus of claim 1 further including a handle attached to the upper surface of said plate.

4. The floor installation apparatus of claim 1 wherein said protector block attaching means comprises a cross bar member attached to the underside of said forward plate portion transverse said plate.

5. The floor installation apparatus of claim 4 further including a pair of rotatable arms, one each attached to each end of said transverse cross bar member.

6. The floor installation apparatus of claim 1 wherein said plate is upwardly curved from said rearward plate portion to said forward plate portion.

7. The floor installation apparatus of claim 1 further including a sledgehammer having a handle and a head, said head having a striking surface, said sledgehammer to be used in conjunction with said apparatus for striking said protector block.

8. The floor installation apparatus of claim 7 further including a sledgehammer attachment affixed to said sledgehammer, said attachment including A. a protector block striking face plate of a size greater than said striking surface; and B. means to affix said striking face plate to said sledgehammer over said striking surface.

9. The floor installation apparatus of claim 8 wherein said sledgehammer striking surface and said protector block striking face plate form an acute angle when said attachment is affixed to said sledgehammer.

10. The floor installation apparatus of claim 9 wherein said sledgehammer attachment further includes;

A. a base plate attached to said striking face plate; and

B. a pair of spaced apart side members attached one each to each side of said base plate to form a pocket for receiving said sledgehammer head.

11. The floor installation apparatus of claim 10 further including a first clamp member attached to said base plate for securing said sledgehammer head to said base plate.

12. The floor installation apparatus of claim 11 further including a second clamp member attached to said base plate for securing said base plate to said to said sledgehammer handle.

* * * * *